US009264799B2

(12) United States Patent
Rosca et al.

(10) Patent No.: US 9,264,799 B2
(45) Date of Patent: Feb. 16, 2016

(54) METHOD AND APPARATUS FOR ACOUSTIC AREA MONITORING BY EXPLOITING ULTRA LARGE SCALE ARRAYS OF MICROPHONES

(71) Applicants: Justinian Rosca, West Windsor, NJ (US); Heiko Claussen, Plainsboro, NJ (US); Radu Victor Balan, Rockville, NJ (US)

(72) Inventors: Justinian Rosca, West Windsor, NJ (US); Heiko Claussen, Plainsboro, NJ (US); Radu Victor Balan, Rockville, NJ (US)

(73) Assignees: Siemens Aktiengesellschaft, Munich (DE); University of Maryland, Maryland ( * ) Notice: Subject to any disclaimer, the term of this patent is extended or adjusted under 35 U.S.C. 154(b) by 646 days.

(21) Appl. No.: 13/644,432

(22) Filed: Oct. 4, 2012

(65) Prior Publication Data

US 2014/0098964 A1 Apr. 10, 2014

(51) Int. Cl.
*H04R 3/00* (2006.01)
*H04R 1/40* (2006.01)

(52) U.S. Cl.
CPC ..... *H04R 1/406* (2013.01); *H04R 3/005* (2013.01); *H04R 2430/03* (2013.01); *H04R 2430/23* (2013.01)

(58) Field of Classification Search
CPC ..... H04L 27/34; H04L 27/2053; H03D 2200/005; H03D 2200/006
USPC ..... 381/91–93, 95, 356, 122, 118–119, 26; 367/118–130; 704/270, 275
See application file for complete search history.

(56) References Cited

U.S. PATENT DOCUMENTS

| | | | | |
|---|---|---|---|---|
| 4,485,484 | A * | 11/1984 | Flanagan | 381/92 |
| 4,741,038 | A * | 4/1988 | Elko et al. | 381/92 |
| 7,149,691 | B2 | 12/2006 | Balan et al. | |
| 8,576,769 | B2 * | 11/2013 | Zheng | 370/316 |
| 2012/0093344 | A1 * | 4/2012 | Sun et al. | 381/122 |
| 2013/0029684 | A1 * | 1/2013 | Kawaguchi et al. | 455/456.1 |

OTHER PUBLICATIONS

Brunelli et al, A generative approach to audio visual person tracking, 2006.*
Brutti_alessio, Distributed microphone networks for sound source localization in smart room, 2007.*
Zotkin et al, Accelerated speech source localization via hierarchical search of steered response power, 2004.*
deJong, Audiroty Occupancy Grids With a Mobile Robot, Mar. 2012.*

(Continued)

*Primary Examiner* — Davetta W Goins
*Assistant Examiner* — Kuassi Ganmavo

(57) ABSTRACT

Systems and methods are provided to create an acoustic map of a space containing multiple acoustic sources. Source localization and separation takes place by sampling an ultra large microphone array containing over 1020 microphones. The space is divided into a plurality of masks, wherein each masks represents a pass region and a complementary rejection region. Each mask is associated with a subset of microphones and beamforming filters that maximize a gain for signals coming from the pass region of the mask and minimizes the gain for signals from the complementary region according to an optimization criterion. The optimization criterion may be a minimization of a performance function for the beamforming filters. The performance function is preferably a convex function. A processor provides a scan applying the plurality of masks to locate a target source. Processor based systems to perform the optimization are also provided.

20 Claims, 7 Drawing Sheets

(56) References Cited

OTHER PUBLICATIONS

Martinson et al, Robotic Discovery of the auditory scene, 2007.*
E. Weinstein, K. Steele, A. Agarwal, and J. Glass, LOUD: A 1020-Node Microphone Array and Acoustic Beamformer. International congress on sound and vibration (ICSV), 2007.
H. F. Silverman, W.R. Patterson, and J.L. Flanagan. The huge microphone array. Technical report, LEMS, Brown University, 1996.
M. S. Brandstein, and D. B. Ward. Cell-Based Beamforming (CE-BABE) for Speech Acquisition with Microphone Arrays. Transactions on speech and audio processing, vol. 8, No. 6, pp. 738-743, 2000.
J. Li, Y. Xie, P. Stoica, X. Zheng, and J. Ward. Beampattern Synthesis via a Matrix Approach for Signal Power Estimation. Transactions on signal processing, vol. 55, No. 12, pp. 5643-5657, 2007.
Lebret, and S. Boyd. Antenna Array Pattern Synthesis via Convex Optimization. Transactions on signal processing, vol. 45, No. 3, pp. 526-532, 1997.
J. Rosca et al. Mobile Interaction with Remote Worlds: The Acoustic Periscope, 6 pages, Proceedings of the AAAI 01.(2001).

* cited by examiner o = Active Microphone(s)

= Pass Region

= Rejection Region

| | | | | | | | |
|---|---|---|---|---|---|---|---|
| L | L | L | L | L | L | VL | VL |
| L | L | L | L | L | L | VL | L |
| VL | L | L | L | VL | L | L | L |
| VL | VL | VL | VL | VL | L | L | L |
| VL | VL | L | H | L | VL | L | L |
| VL | VL | L | L | L | VL | L | L |

FIG. 6

Results after scan applying masks

H = high

L = low

VL= very low

METHOD AND APPARATUS FOR ACOUSTIC AREA MONITORING BY EXPLOITING ULTRA LARGE SCALE ARRAYS OF MICROPHONES

BACKGROUND OF THE INVENTION

The present invention relates generally to locating, extracting and tracking acoustic sources in an acoustic environment and mapping of the acoustic environment by adaptively employing a very large number of microphones.

Acoustic scene understanding is challenging for complex environments with e.g., multiple sources, correlated sources, non-punctual sources, mixed far field and near field sources, reflections, shadowing from objects. The use of ultra large arrays of microphones to acoustically monitor a 3D space has significant advantages. It allows improving source recognition and source separation, for instance. Though methods exist to focus a plurality of microphones on acoustic sources, it is believed that no methods exist for source tracking and environmental acoustic mapping that use ultra large sets (>1020) of microphones from which adaptively subsets of microphones are selected and signals are processed adaptively.

Accordingly, novel and improved methods and apparatus to apply ultra large (>1020) microphone arrays and to select an appropriate subset of microphones from an very large (below or above 1020) set of microphones and to adaptively process microphone data generated by an ultra large array of microphones to analyze an acoustic scene are required.

SUMMARY OF THE INVENTION

Aspects of the present invention provide systems and methods to perform detection and/or tracking of one or more acoustic sources in an environment monitored by a microphone array by arranging the environment in a plurality of pass region masks and related complementary rejection region masks, each pass region mask being related to a subset of the array of microphones, and each subset being related with a beamforming filter that maximizes the gain of the pass region mask and minimizes the gain for the complementary rejection masks, and wherein signal processing for a pass mask includes the processing of only signals generated by the microphones in the subset of microphones. In accordance with a further aspect of the present invention a method is provided to create an acoustic map of an environment having an acoustic source, comprising: a processor determining a plurality of spatial masks covering the environment, each mask defining a different pass region for a signal and a plurality of complementary rejection regions, wherein the environment is monitored by a plurality of microphones, the processor determining for each mask in the plurality of spatial masks a subset of microphones in the plurality of microphones and a beamforming filter for each of the microphones in the subset of microphones that maximizes a gain for the pass region and minimizes gain for the complementary rejection regions associated with each mask according to an optimization criterion that does not at least initially depend on the acoustic source in the environment; and the processor applying the plurality of spatial masks in a scanning action across the environment on signals generated by microphones in the plurality of microphones to detect the acoustic source and its location in the environment.

In accordance with yet a further aspect of the present invention a method is provided, further comprising: the processor characterizing one or more acoustic sources detected as a result of the scanning action into targets or interferences, based on their spectral and spatial characteristics.

In accordance with yet a further aspect of the present invention a method is provided, further comprising: modifying a first subset of microphones and beamforming filters for the first subset of microphones based on the one or more detected acoustic sources.

In accordance with yet a further aspect of the present invention a method is provided, wherein the plurality of microphones is greater than 1020.

In accordance with yet a further aspect of the present invention a method is provided, wherein the subset of microphones has a number of microphones smaller than 50% of the plurality of microphones.

In accordance with yet a further aspect of the present invention a method is provided, wherein the optimization criterion includes minimizing an effect of an interfering source based on a performance of a matched filter related to the subset of microphones.

In accordance with yet a further aspect of the present invention a method is provided, wherein the performance of the matched filter is expressed as:

$$J((K_n^r(\omega))_{n\in\Omega}) = \left(\sum_{n\in\Omega}|K_n^r(\omega)|^2\right)\left(\sum_{n\in\Omega}|H_{n,r}(\omega)|^2\right) - \left|\sum_{n\in\Omega}K_n^r(\omega)H_{n,r}(\omega)\right|^2;$$

wherein J is an objective function that is minimized, $K_n^r(\omega)$ defines a beamforming filter for a source r to a microphone n in the subset of microphones $\Omega$ in a frequency domain, $H_{n,r}(\omega)$ is a transfer function from a source r to microphone n in the frequency domain and $\omega$ defines a frequency.

In accordance with yet a further aspect of the present invention a method is provided, wherein the wherein the performance of the [matched] filter is expressed as a convex function that is optimized.

In accordance with yet a further aspect of the present invention a method is provided, wherein the convex function is expressed as:

$$D(Z) = Z^T RZ + \mu\log\left(\sum_{l=0,1\neq r}^{L} e^{Z^T Q_l Z}\right) + \lambda\|Z\|_1,$$

wherein Z is a vector in a frequency domain containing a real part of coefficients and an imaginary part of coefficients defining the filter in the frequency domain, $Q_l$ is a matrix defined by a real part and an imaginary part of a transfer function from a source l to a microphone in the frequency domain, R is a matrix defined by a real part and an imaginary part of a transfer function from a source r to a microphone in the frequency domain, r indicates a target source, T indicates a transposition, e indicates the base of the natural logarithm, $\mu$ and $\lambda$ are cost factors, and $\|Z\|_1$ is an $l^1$-norm of Z.

In accordance with yet a further aspect of the present invention a method is provided, wherein the convex function is expressed as: $F(Z)=\tau+\lambda\|Z\|_1$, wherein Z is a vector in a frequency domain containing a real part of coefficients and an imaginary part of coefficients defining the filter in the frequency domain, F(Z) is the convex function, $\tau$ is the maximum processing gain from interference sources, $\lambda$ is a cost factor and $\|Z\|_1$ is an $l^1$-norm of Z.

In accordance with yet a further aspect of the present invention a method is provided, wherein the convex function is expressed as: $F(Z^1, Z^2, \ldots, Z^P)=\Sigma_{p=1}^{P}\tau_p+$ $\lambda\Sigma_{k=1}^{N}\max_{1\le p\le P}|Z_k^p|$, wherein: $\tau_1, \ldots, \tau_P$ are real numbers corresponding to maximum processing gains from interference sources at P frequencies, $Z^1, \ldots, Z^P$ are P vectors in a frequency domain containing a real part of coefficients and an imaginary part of coefficients defining the filter in the frequency domain, F(Z) is the convex function.

In accordance with another aspect of the present invention a system is provided to create an acoustic map of an environment having at least one acoustic source, comprising: a plurality of microphones, a memory enabled to store data, a processor enabled to execute instructions to perform the steps: determining a plurality of spatial masks covering the environment, each mask defining a different pass region for a signal and a plurality of complementary rejection regions, wherein the environment is monitored by the plurality of microphones, determining for each mask in the plurality of spatial masks a subset of microphones in the plurality of microphones and a beamforming filter for each of the microphones in the subset of microphones that maximizes a gain for the pass region and minimizes gain for the complementary rejection regions associated with each mask according to an optimization criterion that does not at least initially depend on the acoustic source in the environment and applying the plurality of spatial masks in a scanning action across the environment on signals generated by microphones in the plurality of microphones to detect the acoustic source and its location in the environment.

In accordance with yet another aspect of the present invention a system is provided, further comprising: characterizing one or more acoustic sources detected as a result of the scanning action into a target or an interference, based on spectral and spatial characteristics.

In accordance with yet another aspect of the present invention a system is provided, further comprising: modifying a first subset of microphones and beamforming filters for the first subset of microphones based on the one or more detected acoustic sources.

In accordance with yet another aspect of the present invention a system is provided, wherein the plurality of microphones is greater than 1020.

In accordance with yet another aspect of the present invention a system is provided, wherein the subset of microphones has a number of microphones smaller than 50% of the plurality of microphones.

In accordance with yet another aspect of the present invention a system is provided, wherein the optimization criterion includes minimizing an effect of an interfering source on a performance of a matched filter related to the subset of microphones.

In accordance with yet another aspect of the present invention a system is provided, wherein the performance of the matched filter is expressed as:

$$J((K_n^r(\omega))_{n\in\Omega}) = \left(\sum_{n\in\Omega}|K_n^r(\omega)|^2\right)\left(\sum_{n\in\Omega}|H_{n,r}(\omega)|^2\right) - \left|\sum_{n\in\Omega}K_n^r(\omega)H_{n,r}(\omega)\right|^2$$

wherein, J is an objective function that is minimized, $K_n^r(\omega)$ defines a beamforming filter for a source r to a microphone n in the subset of microphones $\Omega$ in a frequency domain, $H_{n,r}(\omega)$ is a transfer function from a source r to microphone n in the frequency domain and $\omega$ defines a frequency.

In accordance with yet another aspect of the present invention a system is provided, wherein the performance of the matched filter is expressed as a convex function that is optimized.

In accordance with yet another aspect of the present invention a system is provided, wherein the convex function is expressed as:

$$D(Z) = Z^T RZ + \mu\log\left(\sum_{l=0,l\neq r}^{L} e^{Z^T Q_l Z}\right) + \lambda\|Z\|_1,$$

wherein Z is a vector in a frequency domain containing a real part of coefficients and an imaginary part of coefficients defining the filter in the frequency domain, $Q_l$ is a matrix defined by a real part and an imaginary part of a transfer function from a source l to a microphone in the frequency domain R is a matrix defined by a real part and an imaginary part of a transfer function from a source r to a microphone in the frequency domain, r indicates a target source, T indicates a transposition, e indicates the base of the natural logarithm, $\mu$ and $\lambda$ are cost factors and $\|Z\|_1$ is an $l^1$-norm of Z.

In accordance with yet another aspect of the present invention a system is provided, wherein the convex function is expressed as: $F(Z)=\tau+\lambda\|Z\|_1$, wherein: Z is a vector in a frequency in containing a real part of coefficients and an imaginary part of coefficients defining the filter in the frequency domain, F(Z) is the convex function, $\tau$ is the maximum processing gain from interference sources, $\lambda$ is a cost factor and $\|Z\|_1$ in an $l^1$-norm of Z.

In accordance with yet another aspect of the present invention a system is provided, wherein the convex function is expressed as: $F(Z^1, Z^2, \ldots, Z^P)=\Sigma_{p=1}^{P}\tau_p+\lambda\Sigma_{k=1}^{N}\max_{1\le p\le P}|Z_k^p|$, wherein: $\tau_1, \ldots, \tau_P$ are real numbers corresponding to maximum processing gains from interference sources at P frequencies, $Z^l, \ldots, Z^P$ are P vectors in a frequency domain containing a real part of coefficients and an imaginary part of coefficients defining the filter in the frequency domain, F(Z) is the convex function.

BRIEF DESCRIPTION OF THE DRAWINGS

FIG. 6 illustrates a detection result by applying one or more steps in accordance with various aspects of the present invention.

DETAILED DESCRIPTION

Figure 1:
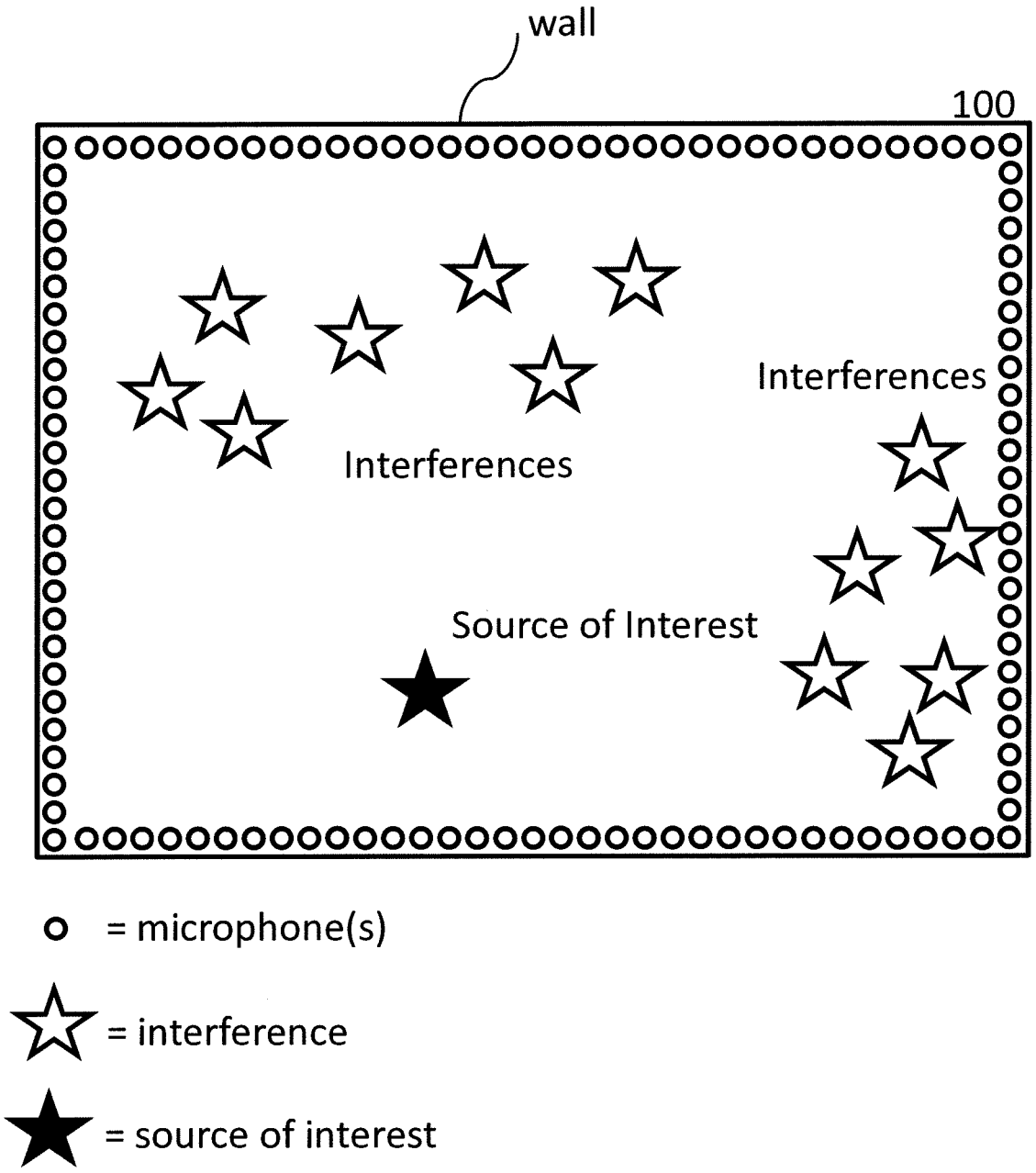
FIG. 1 illustrates a scenario of interest in accordance with various aspects of the present invention.

One issue that is addressed herein in accordance with an aspect of the present invention is acoustic scene understanding by applying an ultra large array of microphones. The subject of acoustic scene understanding has been addressed in a different way in commonly owned U.S. Pat. No. 7,149,691 to Balan et al., issued on Dec. 12, 2006, which is incorporated herein by reference, wherein ultra large microphones are not applied.

In the current approach a number of high level processes are assumed:

(1) Localization of acoustic sources in the environment, representing both targets and interferences, and further source classification;

(2) Tracking of features of the sources or even separation of target sources of interest;

(3) Mapping the environment configuration such as location of walls and determination of room layout and obstacles.

A target herein is a source of interest. A target may have a specific location or certain acoustic properties that makes it of interest. An interference herein is any acoustic source that is not of interest to be analyzed. It may differ from a target by its location or its acoustic signature. Because the interference is not of interest, it will be treated as undesired and will be ignored if that is possible or it will be suppressed as much as possible during processing.

Acoustic radars have been used in the nineteen hundreds and the twentieth century, for instance for source localization and tracking, and later abandoned in favor of the electro agnetic radar.

In accordance with an aspect of the present invention the extraction and tracking of acoustic features of entire sources are pursued, while mapping the acoustic environment surrounding a source. This may include pitch of a speaker's voice, energy pattern in the time-frequency domain of a machine and the like. This approach goes beyond the idea of an acoustic radar.

A limited number of sensors offer little hope with the present state of the art sound technology to completely map a complex acoustic environment e.g., which contains a large number of correlated sources. One goal of the present invention is to adaptively employ a large set of microphones distributed spatially in the acoustic environment which may be a volume of interest. Intelligent processing of data from a large set of microphones will necessarily involve definition of subsets of microphones suitable to scan the audio field and estimate targets of interest.

One scenario that applies various aspects of the present invention may include the following constraints: a) The acoustic environment is a realistic and real acoustic environment (characterized by reflections, reverberation, and diffuse noise); b) the acoustic environment overlaps and mixes large number of sources e.g. 20-50; c) possibly a smaller number of sources of interest exist, e.g. 1-10, while the others represent mutual interferences and noise. One goal is to sense the acoustic environment with a large microphone set, e.g., containing 1000 or more microphones or containing over 1020 or over 1030 microphones, at a sufficient spatial density to deal with the appropriate number of sources, amount of noise, and wavelengths of interest.

An example scenario is illustrated in FIG. 1. FIG. 1 illustrates a space 100 with a number of acoustic interferences and at least one acoustic source of interest. One application in accordance with an embodiment of the present invention is where a fixed number of sources in a room are known and the system monitors if some other source enters the room or appears in the room. This is useful in a surveillance scenario. In that case all locations that are not interferences are defined as source locations of interest.

An acoustic source generates an acoustic signal characterized by a location in a space from which it emanates acoustic signals with spectral and directional properties which may change over time.

Regarding interferences, all sources are interferences from the point of each other. Thus, all interferences are also sources, be it unwanted sources. That is, if there are two sources A and B and if one wants to listen to source A then source B is considered to be an interference and if one wants to listen to source B then source A is an interference. Also, sources and interferences can be defined if it is known what it is that is listened to or what is considered to be a disturbance. For example, if there are people talking in an engine room and one is interested in the signals from the conversation it is known what features speech has (sparse in the time frequency content, pitch and resonances at certain frequencies etc.). It is also known that machines in general generate a signal with a static spectral content. A processor can be programmed to search for these characteristics and classify each source as either "source" or as "interference".

The space 100 in FIG. 1 is monitored by a plurality of microphones which preferably are hundreds of microphones, more preferably thousand or more microphones and most preferably over 1020 microphones. The microphones in this example are placed along a wall of a space and are uniformly distributed along the wall. An optimal microphone spacing is dependent on frequencies of the sources and the optimal microphone location is dependent on the unknown source locations. Also, there may be practical constraints in each application (e.g., it is not possible to put microphones in certain locations or there might be wiring problems). In one embodiment of the present invention a uniform distribution of microphones in a space is applied, for instance around the walls of a space such as a room. In one embodiment of the present invention microphones are arranged in a random fashion on either the walls or in 2D on the ceiling or floor of the room. In one embodiment of the present invention microphones are arranged in a logarithmic setup on either the walls or in 2D on the ceiling or floor of the room.

It may be difficult to sample all microphones simultaneously as such an endeavor would generate a huge amount of data, which with over 1000 or over 1020 microphones appears computationally infeasible to take place in real-time.

Next steps that are performed in accordance with various aspects of the present invention are: to (1) localize sources and interferences, (2) to select a subset from the large number of microphones that best represent the scene and (3) to find weight vectors for beam pattern that best enable the extraction of the sources of interest while disregarding the interferences.

Acoustic scene understanding is challenging for complex environments with e.g., multiple sources, correlated sources, large/area sources, mixed far field and near field sources, reflections, shadowing from objects etc. When extracting and evaluating a single source from the scene, all other sources are considered interferers. However, reliable feature extraction and classification relies on good signal-to-noise or SNRs (e.g., larger then 0 dB). This SNR challenge can be addressed by using beamforming with microphone arrays. For the far field case, the SNR of the target source increases linearly with the number of microphones in the array as described in "[1] E. Weinstein, K. Steele, A. Agarwal, and J. Glass, LOUD: A 1020-Node Microphone Array and Acoustic Beamformer. International congress on sound and vibration (ICSV), 2007."

Therefore, microphone arrays enable high system performance in challenging environments as required for acoustic scene understanding. An example for this is shown in "[1] E. Weinstein, K. Steele, A. Agarwal, and J. Glass, LOUD: A 1020-Node Microphone Array and Acoustic Beamformer. International congress on sound and vibration (ICSV), 2007" who describe the world's largest microphone array with 1020 microphones. In "[1] E. Weinstein, K. Steele, A. Agarwal, and J. Glass, LOUD: A 1020-Node Microphone Array and Acoustic Beamformer. International congress on sound and vibration (ICSV), 2007" it is also shown that the peak SNR increases by 13.7 dB when exploiting a simple delay-and-sum beamformer. For the presented speech recognition tasks, the microphone array results in an 87.2% improvement of the word error rate with interferers present. Similarly, "[2] H. F. Silverman, W. R. Patterson, and J. L. Flanagan. The huge microphone array. Technical report, LEMS, Brown University, 1996" analyzes the performance of large microphone arrays using 512 microphones and traditional signal processing algorithms.

Related work in the area of scene understanding is presented in "[4] M. S. Brandstein, and D. B. Ward. Cell-Based Beamforming (CE-BABE) for Speech Acquisition with Microphone Arrays. Transactions on speech and audio processing, vol. 8, no 6, pp. 738-743, 2000" which uses a fixed microphone array configuration that is sampled exhaustively. The authors split the scene in a number of cells that are separately evaluated for their energy contribution to the overall signal.

Additionally, they consider reflections by defining an external region with virtual, mirrored sources. The covariance matrix of the external sources is generated using a sin c function and thus assuming far field characteristics. By minimizing the energy of the interferences and external sources they achieve an improvement of approximately 8 dB over the SNR of a simple delay-and-sum beamformer. All experiments are limited to a set of 64 microphones but promise further gains over results reported in "[1] E. Weinstein, K. Steele, A. Agarwal, and J. Glass, LOUD: A 1020-Node Microphone Array and Acoustic Beamformer. International congress on sound and vibration (ICSV), 2007" given a similar number of microphones. This shows that careful consideration has to be given to the beam pattern design in order to best utilize the microphone array at hand.

An alternative approach for beampattern design for signal power estimation is given in "[5] J. Li. Y. Xie, P. Stoica, X. Zheng, and J. Ward. Beampattern Synthesis via a Matrix Approach for Signal Power Estimation. Transactions on signal processing, vol. 55, no 12, pp. 5643-5657, 2007." This method generalizes the conventional search for a single weighting vector based beampattern to a combination of weighting vectors, forming a weighting matrix.

This relaxation from rank 1 solutions to solutions with higher rank converts the required optimization problem from a non-convex to a convex one. The importance and power of formulating beampattern design problems as convex optimization problems is discussed in "[6] H. Lebret, and S. Boyd. Antenna Array Pattern Synthesis via Convex Optimization. Transactions on signal processing, vol 45, no 3, pp. 526-532, 1997." Furthermore, the method in "[5] J. Li, Y. Xie, P. Stoica, X. Zheng, and J. Ward. Beampattern Synthesis via a Matrix Approach for Signal Power Estimation. Transactions on signal processing, vol. 55, no 12, pp. 5643-5657, 2007" gives more flexibility to the beampattern design. For example, it is described how the main lobe is controlled while the highest side lobe of the beam pattern is minimized. Finally, the cited work discusses how to adaptively change the beampattern based on the current data from the source of interest and interferences. Drawbacks of this cited method are its focus on signal power estimation rather than signal extraction and its high computational complexity.

All methods cited above are only in limited part related to the work because none exploits adaptively the microphone array by considering "appropriate" subsets of sensors/microphones. Rather, these cited methods pre-design arrays or heuristically design an array shape good for the application at hand. Furthermore, they cannot be easily scaled beyond present limits (1020), e.g. to 10,000 or 100,000 sensors. An approach provided in accordance with various aspects of the present invention is that sensing (microphone configuration and positions) should be sensitive to the context (acoustic scenario). High dimensionality sensing will allow the flexibility to select an appropriate subset of sensors over space and time, adaptively process data, and better understand the acoustic scene in static or even dynamic scenarios.

A method described herein in accordance with one or more aspects of the present invention targets the creation of an acoustic map of the environment. It is assumed that it is unknown where the sources and interferences are in a space room nor what is considered to be a source and what an interference. Also, there is a very large number of microphones which cannot all be used at the same time due to the fact that this would be very costly on the processing side.

One task is to find areas in the space where energy is emitted. Therefore all microphones are focused on a specific pass region that thereafter is moved in a scanning fashion through the space.

The idea of a pass region is that one can only hear what happens in this pass region and nothing else (thus the rejection regions are ignored). This can be achieved to a certain degree by beamforming. Note that not all microphones are located in favor of every pass region that has to be defined in the scanning process. Therefore, different subsets of microphones are of interest for each pass region. For example microphones on the other side of the room are disregarded as the sound disperses though the distance. The selection of the specific microphones per pass region can be computed offline and stored in a lookup table for the online process. That is, to locate and characterize the target and interference source positions, their number and their spectral characteristics.

Figure 2:
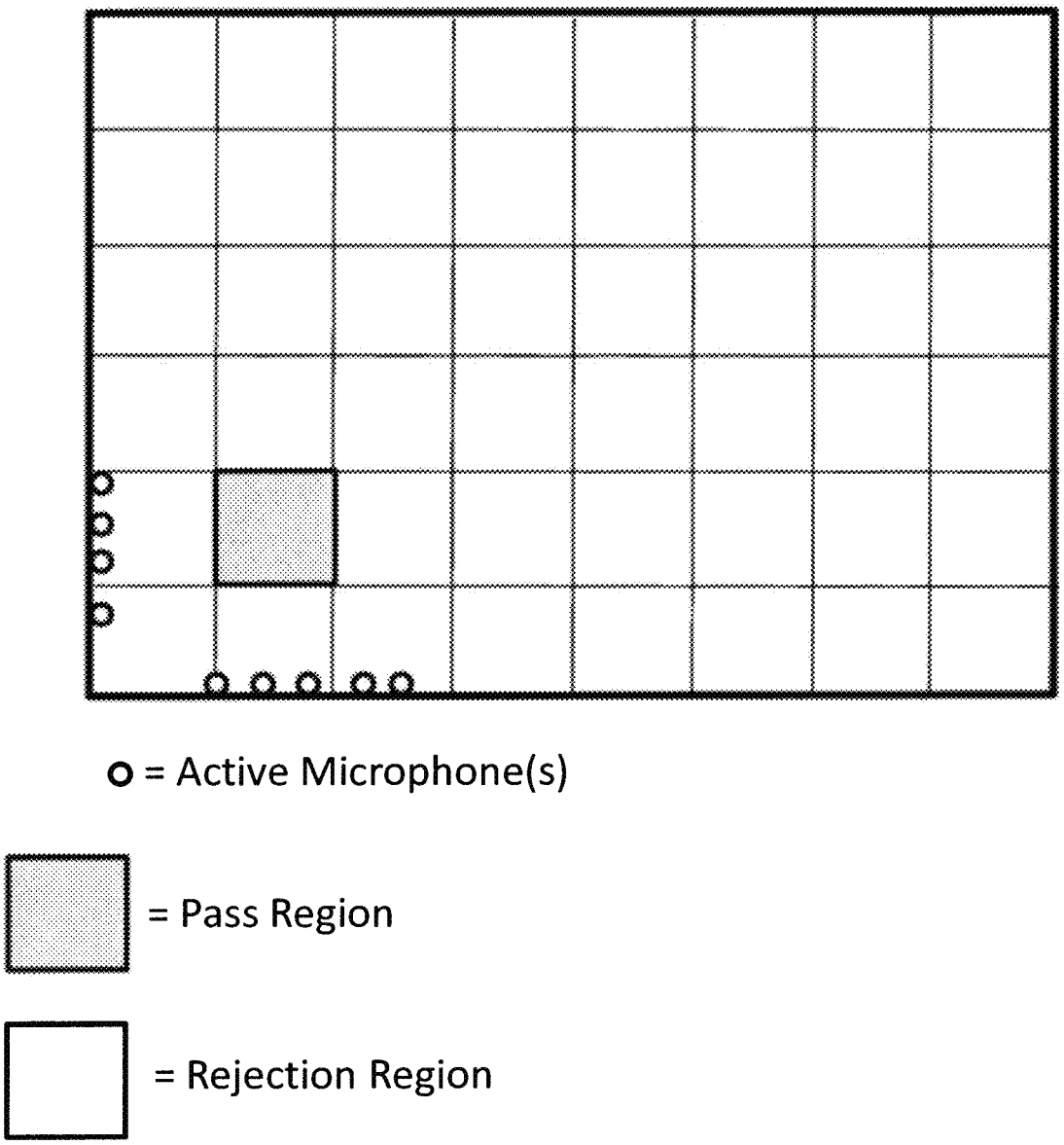
FIG. 2 illustrates a mask and related microphones in an array of microphones in accordance with an aspect of the present invention.
Figure 3:
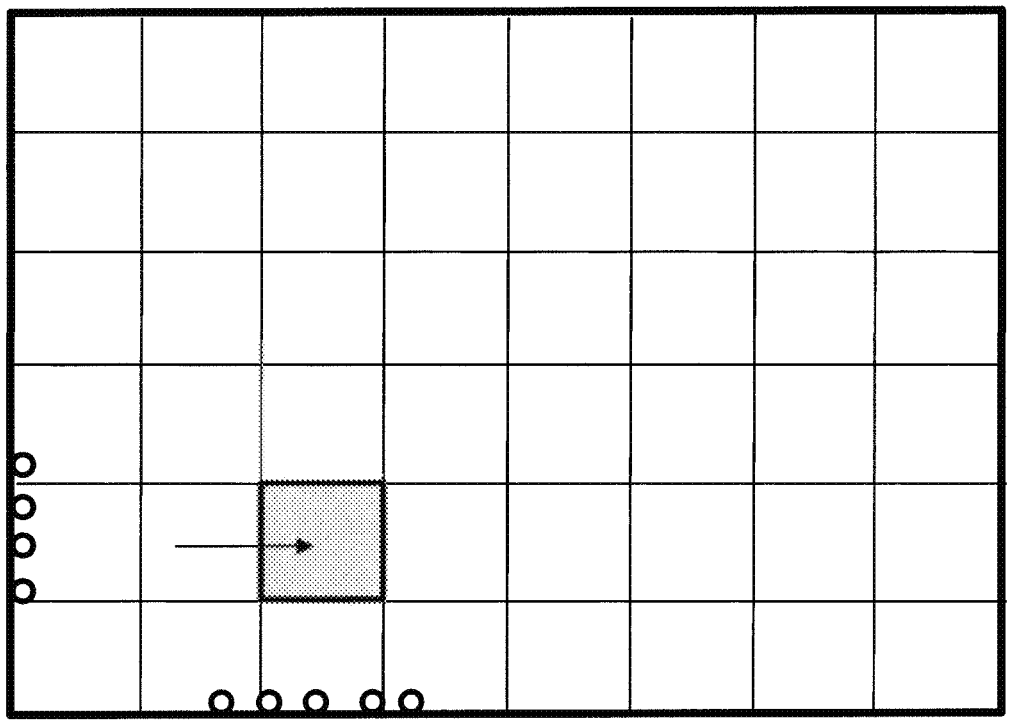
FIG. 3 illustrates another mask and related microphones in an array of microphones in accordance with an aspect of the present invention.

Exemplary steps in the approach are:

1. Predefine a collection of disjoint spatial masks covering the space of interest. Each mask has a pass region or pass regions for the virtual signal of interest, and complementary rejection regions, for assumed virtual interferences. This is illustrated in FIG. 2 with a mask in a first pass region and in FIG. 3 with the mask in a second pass region. It is noted that a virtual source and a virtual signal are an assumed source and an assumed signal applied to a mask to determine for instance the pass regions and rejection regions of such mask.
2. For each mask from the collection, compute a subset of microphones and the beamformer that maximizes gain for the pass region and minimizes gain for all rejection regions according to the optimization criteria which are defined in detail in sections below. This is illustrated in FIGS. 2 and 3, wherein the active microphones associated with the pass region of FIG. 2 are different than the active microphones associated with the pass region of FIG. 3;
3. Source presence and location can be determined by employing the masks in a scanning action across space as illustrated in FIGS. 2 and 3;
4. (Optional) Repeat 1-3 at resolution levels from low to high to refine the acoustic map (sources and the environment);
5. Sources can be characterized and classified into targets or interferences, based on their spectral and spatial characteristics;
6. Post optimization of sensor subsets and beam forming patterns for the actual acoustic scenario structure. For instance, a subset of microphones and the related beamformer for a mask containing or very close to an emitting source can then be further optimized to improve the passing gain for the pass region and to minimize the gain for the rejection region; and 7. Tracking of sources, and exploration repeating steps 1-6 above to detect and address changes in the environment.

The term active microphone herein means that the signal of the microphone in a subset is sampled and will be processed by a processor in a certain step. Signals from other microphones not being in the subset will be ignored in the step.

Figure 4:
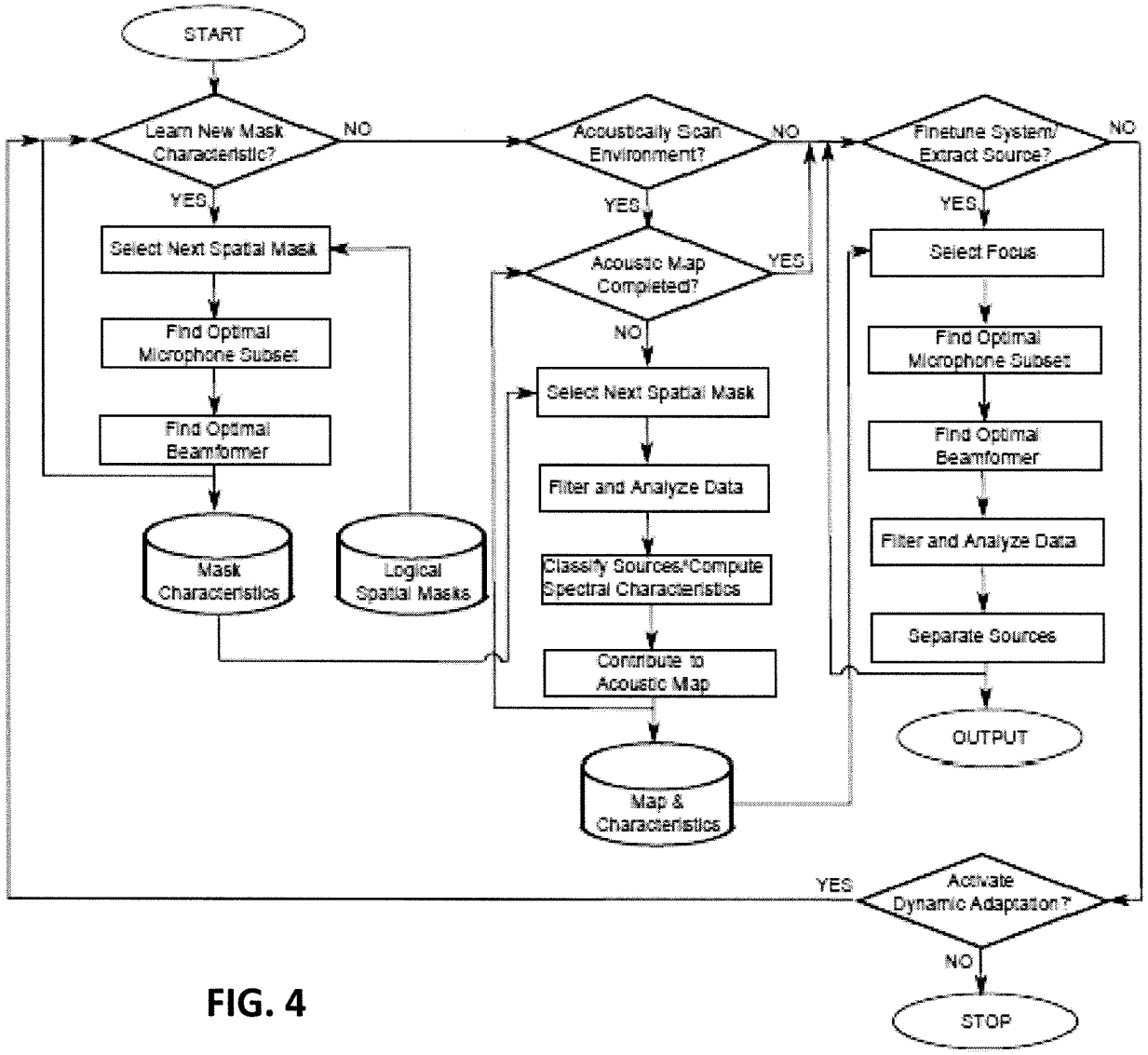
FIG. 4 is a flow diagram illustrating various steps performed in accordance with one or more aspects of the present invention.

The method above does not require a calibration of the acoustic sensing system or environment and does not exploit prior knowledge about source locations or impulse responses. It will exploit knowledge of relative locations of the microphones. In another instance, microphones can be self calibrated for relative positioning. A flow diagram of the method is illustrated in FIG. 4.

In one embodiment of the present invention the optimization criterion does not depend on an acoustic source. In one embodiment of the present invention the optimization criterion does not at least initially depend on an acoustic source.

FIGS. 2 and 3 illustrate the concept of scanning for locations of emitted acoustic energy through masks with different pass and rejection regions. Pass regions are areas of virtual signals of interest, rejection regions are areas of virtual interferences. A mask is characterized by a subset of active sensors and their beamforming parameters. Different sets of microphones are activated for each mask that best capture the pass region and are minimally affected by interferences in the rejection regions.

The selected size and shape of a mask depends on the frequency of a tracked signal component in a target signal among other parameters. In one embodiment of the present invention a mask covers an area of about 0.49 m×0.49 m or smaller to track/detect acoustic signals with a frequency of 700 Hz or greater. In one embodiment of the present invention masks for pass regions are evaluated when combined cover the complete room. In one embodiment of the present invention masks of pass regions are determined that cover a region of interest which may be only part of the room.

In accordance with an aspect of the present invention beam forming properties or pass properties associated with each mask and the related rejection regions are determined and optimized based on signals received by a subset of all the microphones in the array. Preferably there is an optimal number and locations of microphones of which the signals are sampled and processed in accordance with an adaptive beam forming filter. This prevents the necessity of having to use and process the signals of all microphones to determine a single pass mask. A process that would need to be repeated for all pass mask locations, which would clearly not be practical.

In one embodiment of the present invention, a relatively small array of microphones will be used, for instance less than 50. In that case it is still beneficial to use only an optimal subset of microphones determined from the array with less than 50 microphones. A subset of microphones herein in one embodiment of the present invention is a set that has fewer microphones than the number of microphones in the microphone array. A subset of microphones herein in one embodiment of the present invention is a set that has fewer than 50% of the microphones in the microphone array. A subset of microphones herein in one embodiment of the present invention is a set of microphones with fewer microphones than present in the microphone array and that are closer to their related pass mask than at least a set of microphones in the array that is not in the specific subset. These aspects are illustrated in FIGS. 1-3. FIG. 2 provides a simplified explanation, but a pass region can be more complex. For example, it can be a union of many compact regions in space.

Benefits of using a number of microphones to define a pass region mask that is smaller than the total number of microphones in the array will increase as the total number of microphones in an array increases and a greater number of microphones creates a greater number of signal samples to be processed. In one embodiment of the present invention, an array of microphones has fewer than 101 microphones. In one embodiment of the present invention, an array of microphones has fewer than 251 microphones. In one embodiment of the present invention, an array of microphones has fewer than 501 microphones. In one embodiment of the present invention, an array of microphones will be used with fewer than 1001 microphones. In one embodiment of the present invention, an array of microphones has fewer than 501 microphones. In one embodiment of the present invention, an array of microphones has fewer than 1201 microphones. In one embodiment of the present invention, an array of microphones has more than 1200 microphones.

In one embodiment of the present invention the number of microphones in a subset is desired to be not too large. The subset of microphones in the subset is sometimes a compromise between beamforming properties and number of microphones. To limit the number of microphones in a subset of microphones in an optimization method a term is desired for optimizing the subset that provides a penalty in the result when the number is large.

In one embodiment of the present invention a subset of microphones which has a first number of microphones and beamforming filters for the first subset of microphones is changed to a subset of microphones with a second number of microphones based on one or more detected acoustic sources. Thus, based on detected sources and in accordance with an aspect of the present invention the number of microphones in the subset, for instance as part of an optimization step, is changed.

The pass region mask and the complementary rejection region masks can be determined off-line. The masks are determined independent from actual acoustic sources. A scan of a room applies a plurality of masks to detect a source. The results can be used to further optimize a mask and the related subset of microphones. In some cases one would want to track a source in time and/or location. In that case not all masks need to be activated for tracking if no other sources exist or enter the room.

A room may have several acoustic sources of which one or more have to be tracked. Also, in that case one may apply a limited set of optimized masks and related subsets of microphones to scan the room, for instance if there are no or a very limited number of interfering sources or if the interfering sources are static and repetitive in nature.

Figure 5:
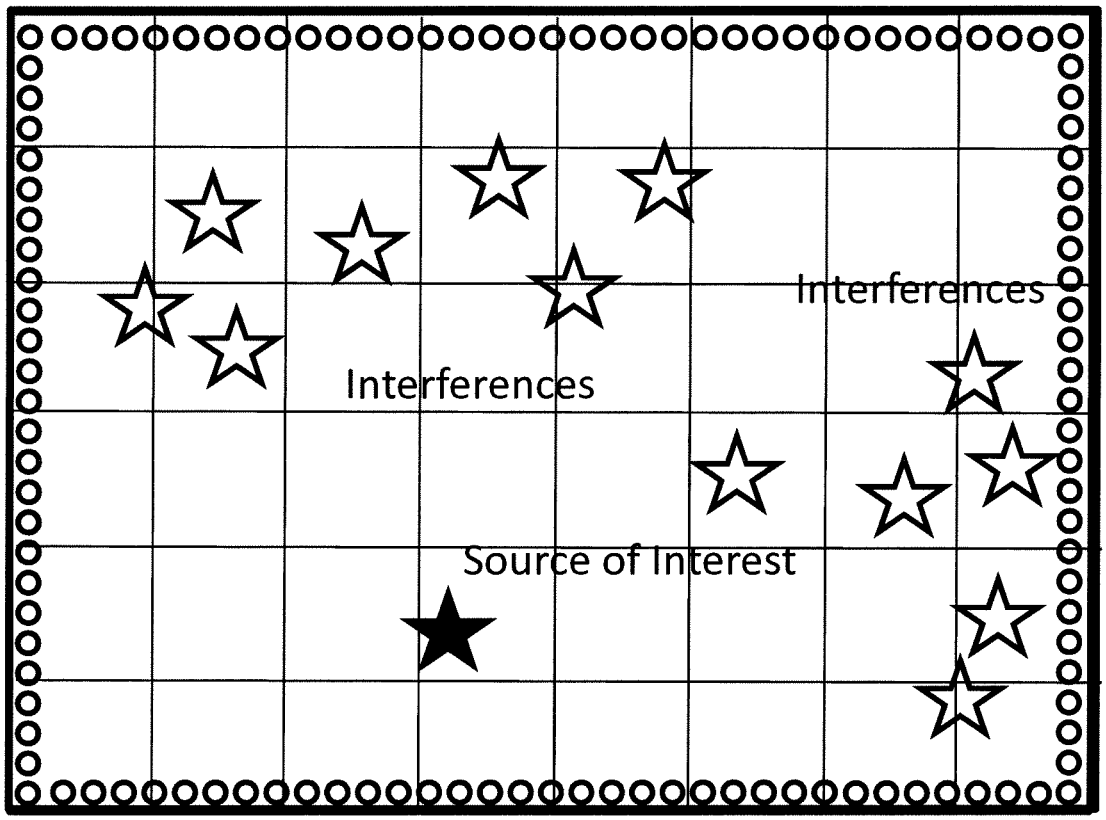
FIG. 5 illustrates application of masks with an array of microphones in an illustrative scenario in accordance with various aspects of the present invention.

FIG. 5 illustrates a scenario of a monitoring of a space with an ultra large array of microphone positioned in a rectangle. FIG. 5 shows small circles representing microphones. About 120 circles are provided in FIG. 5. The number of circles is smaller than 1020. This has been done to prevent cluttering of the drawing and to prevent obscuring other details. In accordance with an aspect of the present invention, the drawings may not depict the actual number of microphones in an array. In one embodiment of the present invention less than 9% of the actual number of microphones is shown. Depending on a preferred set-up, microphones may be spaces at a distance of 1 cm-2 cm apart. One may also use a smaller distance between microphones. One may also use greater distances between microphones.

In one embodiment microphones in an array are spaced in a uniform distribution in at least one dimension. In one embodiment microphones in at least part of the array are spaced in a logarithmic fashion to each other.

FIG. 5 in diagram illustrates a space covered by masks and monitored by microphones in a microphone array as shown in FIGS. 2 and 3. Sources active in the space are shown in FIG. 5. The black star indicates a target source of interest, while the white stars indicates active sources that are considered interferences. As a result of scanning the space with the different masks, wherein each mask is supported by its own set of (optimally selected) microphones, may generate a result as shown in FIG. 6. As an illustrative example the scan result is indicated as VL=Very Low, L=Low. M=Medium and H=High level of signal. Other types of characterization of a mask area are possible and are fully contemplated, and may include a graph of an average spectrum, certain specific frequency comporients, etc.

FIG. 6 shows that the source of interest is identified in one mask location (marked as H) and that all other masks are marked as low or very low. Further tracking of this source may be continued by using the microphones for the mask capturing the source and if the source is mobile possibly the microphones in the array corresponding to the masks surrounding the area of the source.

Optimization

Assume one predefined spatial mask covering the space of interest from the collection of masks. It has a pass region for the virtual signal of interest, and complementary rejection regions, for assumed virtual interferences, so one can assume that virtual interference locations are known (preset), and the virtual source locations are known. Assume an anechoic model:

$$x_n(t) = \sum_{l=1}^{L} a_{n,l} s_l(t - \kappa_{n,l}) + v_n(t), \quad 1 \le n \le N \tag{1}$$

where N denotes the number of sensors (microphones), L the number of point source signals, $v_n$ (t) is the noise realization at time t and microphone n, $x_n(t)$ is the recorded signal by microphone n at time t, $s_l(t)$ is the source signal l at time t, $a_{n,l}$ is the attenuation coefficient from source l to microphone n, and $k_{n,l}$ is the delay from source l to microphone n.

The agnostic virtual source model makes the following assumptions:

1 Source signals are independent and have no spatial distribution (i.e. point-like sources);

2. Noise signals are realizations of independent and identically distributed random variables;

3. Anechoic model but with a large number of virtual sources;

4. Microphones are identical, and their location is known;

The above assumption 3 suggests to assume the existence of a virtual source in each cell of a fine space grid.

Let $M_n(\xi_n,\eta_n,\zeta_n)$ be the location of microphone n, and $P_l(\xi^l,\eta^l,\zeta^l)$ be the location of cell l. Then $$a_{n,l} = \frac{d}{d_{n,l}},\ \kappa_{n,l} = \frac{d_{n,l}}{c},\ d_{n,l} = \sqrt{(\xi_n + \xi^l)^2 + (\eta_n + \eta^l)^2 + (\zeta_n + \zeta^l)^2} \tag{2}$$

with c is the speed of sound and d can be chosen to $d=\min_n d_{n,l}$.

In accordance with an aspect of the present invention plain beamforming is extended into each cell of the grid. Here is the derivation of plain beamforming. Fix the cell index l. Let $$y_l(t) = \sum_{n=1}^{N} \alpha_n x_n(t + \delta_n), \tag{3}$$

with $y_l(t)$ being the output of the beamformer, $\alpha_n$ being weights of each microphone signal and $\delta_n$ time delays of each microphone signal, be an expression for the linear filter. The output is rewritten as:

$$y_l(t) = \sum_{n=1}^{N} a_n a_{n,l} s_l(t - \kappa_{n,l} + \delta_n) + \mathrm{Rest}(t) \tag{4}$$

wherein Rest(t) is the remaining noise and interference.

The equivalent output SNR from source l is obtained assuming no other interference except for noise:

$$\mathrm{Rest}(t) = \sum_{n=1}^{N} \alpha_n v_n(t + \delta_n) \tag{5}$$

The computations are performed in the Fourier domain where the model becomes $$X_n(\omega) = \sum_{l=1}^{L} H_{n,l}(\omega) S_l(\omega) + v_n(\omega)$$

Here $H_{n,l}(\omega)$ the transfer function from source l to microphone n and is assumed to be known). $X_n(\omega)$ is the spectrum of the signal at microphone n, and $S_l(\omega)$ is the spectrum of the signal at source l. The acoustic transfer function H can be calculated from an acoustic model. For instance the website at <URLhttp://sgm-audio.com/research/rir/rir.html> provides a model for room acoustics in which the impulse response functions can be determined for a channel between a virtual source in the room and a location of a microphone.

Let $\Omega \subset \{1, 2, \ldots, N\}$ be a subset of M microphones (those active). One goal is to design processing filters $K_n^r$ for each microphone and each source $l \le r \le L$, $n \in \Omega$ that optimize an objective function J relevant to the separation task. One may consider the whole set of all Ks as a beamforming filter. Full array data is used for benchmarking of any alternate solution. For a target source r, the output of the processing scheme is:

$$Y_r(\omega) = \sum_{n\in\Omega} K_n^r X_n = \underbrace{\left(\sum_{n\in\Omega} K_n^r(\omega) H_{n,r}(\omega)\right) S_r(\omega)}_{\text{target source}} + \underbrace{\sum_{l=1, l\neq r}^{L} \left(\sum_{n\in\Omega} K_n^r(\omega) H_{n,l}(\omega)\right) S_l(\omega)}_{\text{interferers}} + \underbrace{\sum_{n\in\Omega} K_n^r(\omega) v_n(\omega)}_{\text{noise}}$$

The maximum Signal-to-Noise-Ratio processor (which acts in the absence of any interference for source r) is given by the matched filter:

$$K_n^r(\omega)=\overline{H_{n,r}(\omega)}$$

in which case:

$$\left|\sum_{n\in\Omega}\overline{K}_n^r(\omega)H_{n,r}(\omega)\right|^2=\left(\sum_{n\in\Omega}\left|\overline{K}_n^r(\omega)\right|^2\right)\left(\sum_{n\in\Omega}|H_{n,r}(\omega)|^2\right).$$

However this plain beamforming solution matched filter may increase the leakage of interferers into output. Instead it is desired to minimize the "gap" performance to the matched filter:

$$J((K_n^r(\omega))_{n\in\Omega})=\left(\sum_{n\in\Omega}|K_n^r(\omega)|^2\right)\left(\sum_{n\in\Omega}|H_{n,r}(\omega)|^2\right)-\left|\sum_{n\in\Omega}K_n^r(\omega)H_{n,r}(\omega)\right|^2 \tag{6}$$

subject to constraints on interference leakage and noise:

$$\left|\sum_{n\in\Omega}K_n^r(\omega)H_{n,l}(\omega)\right|^2\le\tau_l, \quad 1\le l\le L,\ l\ne r \tag{7}$$

$$\sum_{n\in\Omega}|K_n^r(\omega)|^2\le 1 \tag{8}$$

The real version of the problem is as follows. Set $K_n^r=X_n+iY_n$, $H_{n,l}=A_{n,l}+iB_{n,l}$. The criterion becomes:

$$J(X,Y)=\left(\sum_{n\in\Omega}|X_n|^2+|Y_n|^2\right)\left(\sum_{n\in\Omega}|A_{n,r}|^2+|B_{n,r}|^2\right)-\left|\sum_{n\in\Omega}(A_{n,r}X_n-B_{n,r}Y_n)\right|^2-\left|\sum_{n\in\Omega}(B_{n,r}X_n+A_{n,r}Y_n)\right|^2$$

which is rewritten as:

$$J(X,Y)=[\,X^T\quad Y^T\,]R\begin{bmatrix}X\\Y\end{bmatrix} \tag{9}$$

The constraints are rewritten as:

$$[\,X^T\quad Y^T\,]Q_l\begin{bmatrix}X\\Y\end{bmatrix}=\left|\sum_{n\in\Omega}(A_{n,l}X_n-B_{n,l}Y_n)\right|^2+\left|\sum_{n\in\Omega}(B_{n,l}X_n+A_{n,l}Y_n)\right|^2\le\tau_l \tag{10}$$

and $$[\,X^T\quad Y^T\,]\begin{bmatrix}X\\Y\end{bmatrix}=\sum_{n\in\Omega}(|X_n|^2+|Y_n|^2)\le 1 \tag{11}$$

Here the matrices R and $Q_l$ are given by:

$$Q_l=\begin{bmatrix}A_l\\-B_l\end{bmatrix}[\,A_l^T\quad -B_l^T\,]+\begin{bmatrix}B_l\\A_l\end{bmatrix}[\,B_l^T\quad A_l^T\,] \tag{12}$$

for all $1\le l\le L$ and $$R=(\|A_r\|^2+\|B_r\|^2)I_{2M}-Q_r \tag{13}$$

Consider the following alternative criteria. Recall the setup. It is desired to design weights $K_n$ that give the following gains:

$$\text{Gain}_l=\left|\sum_{n\in\Omega}K_nH_{n,l}\right|^2,\ 1\le l\le L \tag{14}$$

$$\text{Gain}_0=\sum_{n\in\Omega}|K_n|^2 \tag{15}$$

where $1\le\le L$ indexes source l, and $\text{Gain}_0$ is the noise gain.

Signal-to-Noise-Plus-Average-Interference Ratio

Signal-to-Noise-Plus-Average-Interference-Ratio

One possible criterion is to maximize:

$$A(K)=\frac{\text{Gain}_r}{\text{Gain}_0+\sum_{l=1,l\ne r}^{L}\text{Gain}_l} \tag{16}$$

Since this is a ratio of quadratics (a generalized Rayleigh quotient) the optimal solution is given by a generalized eigenvector.

The problem with this criterion is that it does not guarantee that each individual $\text{Gain}_1$ is small. There might exist some interferers that have large gains, and many other sources with small gains.

Advantage: Convex

Disadvantage: (a) Does not guarantee that each interference gain is small. There may be a source with a large gain if there are many others with small gains. (b) Does not select a subset of microphones nor penalizes the use of a large number of microphones Signal-to-Worst-Interference-Ratio A more preferred criterion is:

$$B(K)=\frac{\text{Gain}_r}{\max_{0\le l\le L,l\ne r}\text{Gain}_l} \tag{17}$$

However it is not obvious if this criterion can be solved efficiently (like the Rayleigh quotient).

Advantage: Guarantees that each interference gain is below a predefined limit.

Disadvantage: (a) Not obvious if it can be solved efficiently (b) Does not select a subset of microphones nor penalizes the use of a large number of microphones.

Wiener Filter

Assume that the noise spectral power is $\sigma_0^2$, then the optimizer of $$C(K) = E\left[\left|\left(\sum_{n\in\Omega} K_n H_{n,r} - 1\right)S_r\right|^2 + \left|\sum_{l=1,l\neq r}^{L}\left(\sum_{n\in\Omega} K_n H_{n,l}\right)S_l\right|^2 + \left|\sum_{n\in\Omega} K_n v_n\right|^2\right] \tag{18}$$

is given by:

$$Z = \rho_r\left(\sigma_0^2 I_{2M} + \sum_{l=1}^{L}\rho_l Q_l\right)^{-1}\begin{bmatrix} A_r \\ -B_r \end{bmatrix} \tag{19}$$

where $\rho_l = E[|s_l|^2]$, $\sigma_0^2 = E[|v_n|^2]$ (all n), and $A_r$, $B_r$, $Q_l$ are matrices constructed in (12) and I is the identity matrix.

Advantage: (a) Closed form solution available (b) Stronger interference sources are attenuated more; weaker interference sources have a smaller effect on filter.

Disadvantage: (a) Does not guarantee that each interference gain is small. There may be a source with a large gain if there are many others with small gains. (b) Does not select a subset of microphones nor penalizes the use of a large number of microphones. (c) Requires the knowledge of all interference sources spectral powers.

Log-Exp Convexification

Following Boyd-Vandenberghe in "[3] S. Boyd, and L. Vandenberghe. Convex Optimization. Cambridge university press, 2009," the maximum of $(x_0, \ldots, x_N)$ can be approximated using the following convex function:

$$\log(e^{x0}+e^{x1}+\ldots+e^{xN})$$

Then a convex function on constraints reads $$J_{log}(K) = \log\left(e^{Z^T Q_0 Z} + e^{Z^T Q_1 Z} + \ldots\ '\ \ldots + e^{Z^T Q_L Z}\right), \quad Z = \begin{bmatrix} X \\ Y \end{bmatrix} = \begin{bmatrix} \mathrm{real}(K) \\ \mathrm{imag}(K) \end{bmatrix} \tag{20}$$

where ' means the $r^{th}$ term is missing, and $Q_0 = I_{2M}$ (the identity matrix).

A second novelty is to merge the outer optimization loop with the inner optimization loop by adding a penalty term involving the number of nonzero filter weights ($K_l$). An obvious choice would be the zero pseudo-norm of this vector. However such choice is not convex. Instead this term is substituted by the $l^1$-norm of vector Z.

Recalling that the interest is in minimizing the gap $Z^T RZ$ given by (9), the full optimization reads:

$$D(Z) = Z^T RZ + \mu\log\left(\sum_{l=0,l\neq r}^{L} e^{Z^T Q_l Z}\right) + \lambda\|Z\|_1 \tag{21}$$

which is convex in the 2M-dimensional variable Z. Here μ and λ are cost factors that weight the interference/noise gains and filter $l^1$-norm against the source of interest performance gap. As before, minimize D subject to real $(K_{n0}^r) = Z_{n0} \geq \alpha$.

Advantage: (a) Can be solved efficiently; (b) Penalizes large numbers of microphones and allows the selection of the subset of microphones of interest. Disadvantage: (a) Only an approximation of the maximum interference used.

Gap+Max+$L^1$ Criterion

Maximum can be used to build a convex optimization problem. The criterion to minimize reads:

$$E(Z) = Z^T RZ + \mu\tau + \lambda\|Z\|_1 \tag{22}$$

subject o the following constraints:

$$\tau \geq 0 \tag{23}$$

$$Z^T Q_l Z \leq \tau,\ 2 \leq l \leq L \tag{24}$$

$$Z^T Z \leq \tau \tag{25}$$

The following unbiased constraint is imposed $$\sum_{k=1}^{N} K_n H_{n,1} = 1 \tag{26}$$

Advantage: (a) Can be solved efficiently; (b) Penalizes large numbers of microphones and allows the selection of the subset of microphones of interest.

Disadvantage: (a) Uses the gain of the source of interest in the cost function.

Max+$L^1$ Criterion

Since the target source is unbiased its gain is guaranteed to be one. Hence a more plausible optimization criterion is given by:

$$F(Z) = \tau + \lambda\|Z\|_1 \tag{27}$$

subject to the following constraints:

$$\tau \geq 0 \tag{28}$$

$$Z^T Q_l Z \leq \tau,\ 2 \leq l \leq L \tag{29}$$

$$Z^T Z \leq \tau \tag{30}$$

where $Z^T Z$ represents the noise gain. Again, the following unbiased constraint is imposed:

$$\sum_{k=1}^{N} K_n H_{n,1} = 1 \tag{26}$$

Advantage: (a) Can be solved efficiently; (b) Penalizes large numbers of microphones and allows the selection of the subset of microphones of interest; (c) Simplification over the Gap+Max+$L^1$ Criterion.

Max+$L^{1,\infty}$ Criterion

When source signals are broadband (such as speech or other acoustic signals) t e optimization criterion becomes:

$$F(Z^1, Z^2, \ldots, Z^P) = \sum_{f=1}^{P}\tau_f + \lambda\sum_{k=1}^{N}\max_{1\leq f\leq P}\left|Z_k^f\right|$$

subject to the constraints (28), (29), (30) for each pair $(\tau_1, Z^1)$, $(\tau_2, Z^2)$, . . . , $(\tau_P, Z^P)$, where the index f denotes a frequency in a plurality of frequencies with P its highest number. (the symbol P is used because F is applied for the function $F(Z^1, Z^2, \ldots, Z^P)$.)

Again, the unbiased constraint (26) is imposed on Z, for each frequency.

Advantages: (a) All advantages of Max+$L^1$ criterion; (b) Addresses multiple frequencies in a unified manner.

It is again noted that in the above the ter "virtual source" is used. A "virtual source" is an assumed source. A source is for instance assumed (as a "virtual source") for a step of the search that a source is at a particular location. That is, it is (a least initially) not known where the interferences are. Therefore, a filter is designed that assumes interferences (virtual interferences as they are potentially not existing) everywhere but at a point of interest that one wants to focus on at a certain moment. This point of interest is moved in multiple steps through the acoustic environment to scan for sources (both interferences and sources of interest).

Figure 7:
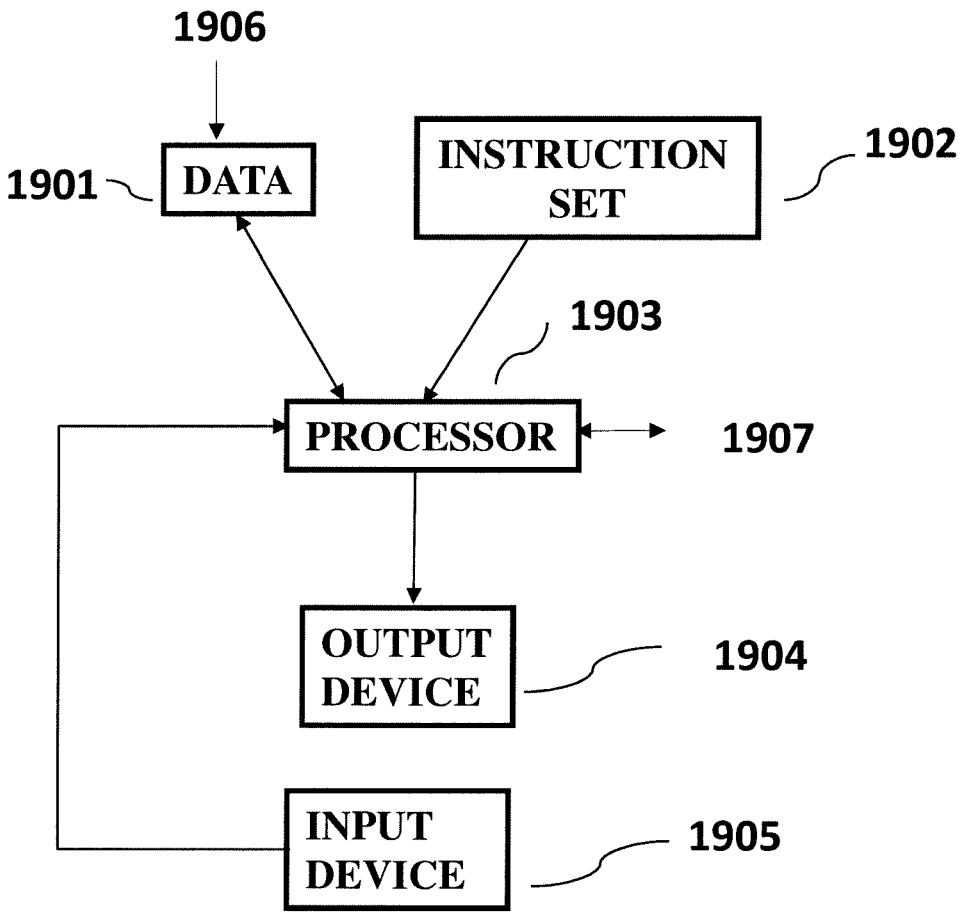
FIG. 7 illustrates a system enabled to perform steps of methods provided in accordance with various aspects of the present invention.

The methods as provided herein are, in one embodiment of the present invention, implemented on a system or a computer device. Thus, steps described herein are implemented on a processor, as shown in FIG. 7. A system illustrated in FIG. 7 and as provided herein is enabled for receiving, processing and generating data. The system is provided with data that can be stored on a memory 1701. Data may be obtained from sensors such as an ultra large microphone array for instance or from any other data relevant source. Data may be provided on an input 1706. Such data may be microphone generated data or any other data that is helpful in a system as provided herein. The processor is also provided or programmed with an instruction set or program executing the methods of the present invention that is stored on a memory 1702 and is provided to the processor 1703, which executes the instructions of 1702 to process the data from 1701. Data, such as microphone data or any other data triggered or caused by the processor can be outputted on an output device 1704, which may be a display to display a result such as a located acoustic source or a data storage device. The processor also has a communication channel 1707 to receive external data from a communication device and to transmit data to an external device. The system in one embodiment of the present invention has an input device 1705, which may include a keyboard, a mouse, a pointing device, one or more cameras or any other device that can generate data to be provided to processor 1703.

The processor can be dedicated or application specific hardware or circuitry. However, the processor can also be a general CPU, a controller or any other computing device that can execute the instructions of 1702. Accordingly, the system as illustrated in FIG. 17 provides a system for processing data resulting from a microphone or an ultra large microphone array or any other data source and is enabled to execute the steps of the methods as provided herein as one or more aspects of the present invention.

In accordance with one or more aspects of the present invention methods and systems for area monitoring by exploiting ultra large scale arrays of microphones have been provided. Thus, novel systems and methods and steps implementing the methods have been described and provided herein.

Tracking can also be accomplished by successive localization of sources. Thus, the processes described herein can be applied to track a moving source by repeatedly applying the localization methods described herein.

The following references are generally descriptive of the background of the present invention and are hereby incorporated herein by reference: [1] E. Weinstein, K. Steele, A. Agarwal, and J. Glass, LOUD: A 1020-Node Microphone Array and Acoustic Beamformer. International congress on sound and vibration (ICSV), 2007; [2] H. F. Silverman, W. R. Patterson, and J. L. Flanagan. The huge microphone array. Technical report, LEMS, Brown University, 1996; [3] S. Boyd, and L. Vandenberghe. Convex Optimization. Cambridge university press, 2009; [4] M. S. Brandstein, and D. B. Ward. Cell-Based Beamforming (CE-BABE) for Speech Acquisition with Microphone Arrays. Transactions on speech and audio processing, vol 8, no 6, pp. 738-743, 2000; [5] J. Li, Y. Xie, P. Stoica, X. Zheng, and J. Ward. Beampattern Synthesis via a Matrix Approach for Signal Power Estimation. Transactions on signal processing, vol. 55, no 12, pp. 5643-5657, 2007; and [6] H. Lebret, and S. Boyd. Antenna Array Pattern Synthesis via Convex Optimization. Transactions on signal processing, vol 45, no 3, pp. 526-532, 1997.

While there have been shown, described and pointed out fundamental novel features of the invention as applied to preferred embodiments thereof, it will be understood that various omissions and substitutions and changes in the form and details of the methods and systems illustrated and in its operation may be made by those skilled in the art without departing from the spirit of the invention. It is the intention, therefore, to be limited only as indicated by the scope of the claims.

The invention claimed is:

1. A method for creating an acoustic map of an environment having at least one acoustic source, comprising:

surrounding the environment with an array of microphones that contains 1000 or more microphones in the array;

a processor determining a plurality of disjoint spatial masks associated with the array of microphones covering the environment, each mask defining a different pass region for a signal and a plurality of complementary rejection regions, wherein the environment is monitored by the array of microphones;

the processor determining for each mask in the plurality of disjoint spatial masks a defined subset of microphones in the array of microphones and a beamforming filter for each of the microphones in the defined subset of microphones that maximizes a gain for the pass region and minimizes gain for the complementary rejection regions associated with each mask according to an optimization criterion that does not depend on the at least one acoustic source in the environment; and the processor applying the plurality of disjoint spatial masks in a scanning action across the environment on signals generated by microphones in the array of microphones to detect the acoustic source and its location in the environment, wherein for each applied spatial mask only samples generated by the corresponding defined subset of microphones are processed by the processor.

2. The method of claim 1, further comprising:

the processor characterizing one or more acoustic sources detected as a result of the scanning action into targets or interferences, based on their spectral and spatial characteristics, or prior knowledge or information.

3. The method of claim 2, further comprising:

changing a first subset of microphones and beamforming filters for the first subset of microphones based on the one or more detected acoustic sources.

4. The method of claim 1, wherein the optimization criterion includes minimizing an effect of an interfering source based on a performance of a filter related to the defined subset of microphones.

5. The method of claim 4, wherein the performance of the filter is expressed as:

$$J((K_n^r(\omega))_{n\in\Omega}) = \left(\sum_{n\in\Omega}|K_n^r(\omega)|^2\right)\left(\sum_{n\in\Omega}|H_{n,r}(\omega)|^2\right) - \left|\sum_{n\in\Omega}K_n^r(\omega)H_{n,r}(\omega)\right|^2;$$

wherein J is an objective function that is minimized;

$K_n^r(\omega)$ defines a beamforming filter for a source r to a microphone n in the subset of microphones Ω in a frequency domain;

$H_{n,r}$ is a transfer function from a source r to microphone n in the frequency domain; and ω defines a frequency.

6. The method of claim 1, comprising repeating the steps of claim 1 to track an acoustical source.

7. The method of claim 6, wherein a performance of the filter is expressed as an optimized convex function as follows:

$$D(Z) = Z^T RZ + \mu\log\left(\sum_{l=0,l\neq r}^{L} e^{Z^T Q_l Z}\right) + \lambda\|Z\|_1,$$

wherein

Z is a vector in a frequency domain containing a real part of coefficients and an imaginary part of coefficients defining the filter;

$Q_l$ is a matrix defined by a real part and an imaginary part of a transfer function from a source l to a microphone in the frequency domain R is a matrix defined by a real part and an imaginary part of a transfer function from a source r to a microphone in the frequency domain;

r indicates a target source;

T indicates a transposition;

e indicates the base of the natural logarithm;

μ and λ are cost factors; and $\|Z\|_1$ is an $l^1$-norm of Z.

8. The method of claim 6, wherein the convex function is expressed as:

$F(Z)=\tau+\lambda\|Z\|_1$, wherein:

Z is a vector in a frequency domain containing a real part of coefficients and an imaginary part of coefficients defining the filter;

F(Z) is the convex function;

τ is a maximum processing gain from an interference source;

λ is a cost factor; and $\|Z\|_1$ is an $l^1$-norm of Z.

9. The method of claim 6, wherein the convex function is expressed as:

$$F(Z^1, Z^2, \ldots, Z^P) = \sum_{p=1}^{P}\tau_p + \lambda\sum_{k=1}^{N}\max_{1\le p\le P}|Z_k^P|,$$

wherein $Z^p$ is a vector in a frequency domain containing a real part of coefficients and an imaginary part of coefficients defining the filter in the frequency domain for a frequency p;

$F(Z^1, Z^2, \ldots, Z^F)$ represents the convex function;

$\tau_p$ is a maximum processing gain from interference sources at frequency p;

λ is a cost factor; and $Z_k^p$ represents a real and imaginary part of a coefficient for microphone k defining the filter for frequency p.

10. The method of claim 1, wherein the plurality of disjoint spatial masks covering the environment includes at least one mask of a single pass region that is completely surrounded by rejection regions.

11. A system to create an acoustic map of an environment having at least one acoustic source, comprising:

an array of microphones containing a plurality of 1000 or more microphones that surround the environment;

a memory enabled to store data;

a processor enabled to execute instructions to perform the steps:

determining a plurality of disjoint spatial masks associated with the array of microphones covering the environment, each mask defining a different pass region for a signal and a plurality of complementary rejection regions, wherein the environment is monitored by the array of microphones;

determining for each mask in the plurality of disjoint spatial masks a defined subset of microphones in the plurality of microphones and a beamforming filter for each of the microphones in the subset of microphones that maximizes a gain for the pass region and minimizes gain for the complementary rejection regions associated with each mask according to an optimization criterion that does not depend on the at least one acoustic source in the environment; and applying the plurality of disjoint spatial masks in a scanning action across the environment on signals generated by microphones in the array of microphones to detect the acoustic source and its location in the environment, wherein for each applied spatial mask only samples generated by the corresponding defined subset of microphones are processed by the processor.

12. The system of claim 11, further comprising:

characterizing one or more acoustic sources detected as a result of the scanning action into a target or an interference, based on spectral and spatial characteristics.

13. The system of claim 12, further comprising:

changing a first subset of microphones and beamforming filters for the first subset of microphones based on the one or more detected acoustic sources.

14. The system of claim 11, wherein the optimization criterion includes minimizing an effect of an interfering source on a performance of a filter related to the defined subset of microphones.

15. The system of claim 14, wherein the filter is a matched filter and the performance of the matched filter is expressed as:

$$J((K_n^r(\omega))_{n\in\Omega}) = \left(\sum_{n\in Q}|K_n^r(\omega)|^2\right)\left(\sum_{n\in Q}|H_{n,r}(\omega)|^2\right) - \left|\sum_{n\in\Omega}K_n^r(\omega)H_{n,r}(\omega)\right|^2;$$

wherein J is an objective function that is minimized;

$K_n^r(\omega)$ defines a beamforming filter for a source r to a microphone n in the subset of microphones Ω in a frequency domain;

$H_{n,r}(\omega)$ is a transfer function from a source r to microphone n in the frequency domain; and ω defines a frequency.

16. The system of claim 14, wherein the wherein the performance of the filter is expressed as a convex function that is optimized.

17. The system of claim 16, wherein the convex function is expressed as:

$$D(Z) = Z^T RZ + \mu \log\left(\sum_{l=0, l\neq r}^{L} e^{Z^T Q_l Z}\right) + \lambda \|Z\|_1,$$

Z is a vector in a frequency domain containing a real part of coefficients and an imaginary part of coefficients defining the filter;

$Q_l$ is a matrix defined by a real part and an imaginary part of a transfer function from a source l to a microphone in the frequency domain;

R is a matrix defined by a real part and an imaginary part of a transfer function from a source r to a microphone in the frequency domain;

r indicates a target source;

T indicates a transposition;

e indicates the base of the natural logarithm;

μ and λ are cost factors; and $\|Z\|_1$ is an $l^1$-norm of Z.

18. The system of claim 16, wherein the convex function is expressed as:

$F(Z)=\tau+\lambda\|Z\|_1$, wherein:

Z is a vector in a frequency domain containing a real part of coefficients and an imaginary part of coefficients defining the filter;

F(Z) is the convex function;

σ is a maximum processing gain from an interference source;

λ is a cost factor; and $\|Z\|_1$ is an $l^1$-norm of Z.

19. The system of claim 16, wherein the convex function is expressed as:

$$F(Z^1, Z^2, \ldots, Z^P) = \sum_{p=1}^{P} \tau_p + \lambda \sum_{k=1}^{N} \max_{1\leq p\leq P} |Z_k^p|,$$

wherein $Z^p$ is a vector in a frequency domain containing a real part of coefficients and an imaginary part of coefficients defining the filter in the frequency domain for a frequency p;

$F(Z^1, Z^2, \ldots, Z^F)$ represents the convex function;

$\tau_p$ is a maximum processing gain from interference sources at frequency p;

λ is a cost factor; and $Z_k^p$ represents a real and imaginary part of a coefficient for microphone k defining the filter for frequency p.

20. The system of claim 11, wherein the plurality of disjoint spatial masks covering the environment includes at least one mask of a single pass region that is completely surrounded by rejection regions.

* * * * *